US009302495B2

(12) United States Patent
Sanbongi et al.

(10) Patent No.: US 9,302,495 B2
(45) Date of Patent: Apr. 5, 2016

(54) THERMAL HEAD, PRINTER, AND METHOD OF MANUFACTURING THERMAL HEAD

(71) Applicant: Seiko Instruments Inc., Chiba (JP)

(72) Inventors: Norimitsu Sanbongi, Chiba (JP); Keitaro Koroishi, Chiba (JP); Toshimitsu Morooka, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 64 days.

(21) Appl. No.: 13/898,823

(22) Filed: May 21, 2013

(65) Prior Publication Data

US 2013/0335500 A1 Dec. 19, 2013

(30) Foreign Application Priority Data

Jun. 19, 2012 (JP) ..... 2012-137796

(51) Int. Cl.

*B41J 2/15* (2006.01)
*B41J 2/335* (2006.01)
*H01C 17/00* (2006.01)

(52) U.S. Cl.

CPC ..... *B41J 2/33515* (2013.01); *B41J 2/3357* (2013.01); *B41J 2/3358* (2013.01); *B41J 2/3359* (2013.01); *B41J 2/33585* (2013.01); *H01C 17/00* (2013.01); *Y10T 29/49083* (2015.01)

(58) Field of Classification Search

CPC ..... B41J 2/335; B41J 2/3353; B41J 2/33535; B41J 2/3355

USPC ..... 347/200–210

See application file for complete search history.

(56) References Cited

U.S. PATENT DOCUMENTS

| | | | | |
|---|---|---|---|---|
| 6,529,224 | B2 * | 3/2003 | Shirakawa et al. | 347/200 |
| 7,248,275 | B2 * | 7/2007 | Okitsu | 347/208 |
| 7,768,541 | B2 * | 8/2010 | Koroishi et al. | 347/202 |
| 8,253,765 | B2 * | 8/2012 | Shoji et al. | 347/200 |
| 8,256,099 | B2 * | 9/2012 | Shoji et al. | 29/611 |
| 8,339,431 | B2 | 12/2012 | Sanbongi et al. | 347/200 |
| 8,372,296 | B2 * | 2/2013 | Shoji et al. | 216/13 |
| 8,384,749 | B2 * | 2/2013 | Morooka et al. | 347/200 |
| 8,998,385 | B2 * | 4/2015 | Morooka et al. | 347/56 |

FOREIGN PATENT DOCUMENTS

| | | |
|---|---|---|
| JP | 2011121337 | 6/2011 |

* cited by examiner

*Primary Examiner* — Lamson Nguyen
(74) *Attorney, Agent, or Firm* — Adams & Wilks

(57) ABSTRACT

A thermal head has a support substrate, an upper substrate arranged on the support substrate on one surface side thereof in a laminated state, and an intermediate layer arranged between the upper substrate and the support substrate to bond the upper substrate and the support substrate to each other. The intermediate layer has one of a through hole and a concave portion forming a cavity portion between the upper substrate and the support substrate. A heat generating resistor is formed on a surface of the upper substrate on a side opposite to the support substrate at a position opposed to the cavity portion. The intermediate layer is formed of a glass paste having a melting point lower than a firing temperature of the support substrate and higher than a melting temperature of the upper substrate.

12 Claims, 6 Drawing Sheets

THERMAL HEAD, PRINTER, AND METHOD OF MANUFACTURING THERMAL HEAD

BACKGROUND OF THE INVENTION

1. Field of the Invention

The present invention relates to a thermal head, a printer, and a method of manufacturing the thermal head.

2. Description of the Related Art

There are conventionally known a thermal printer to be mounted on a personal digital assistant as typified by a compact handy terminal, and a thermal head to be used in the thermal printer to perform printing on a thermal recording medium by selectively driving a plurality of heating elements based on print data. Longer battery duration is required for the personal digital assistant, and therefore a thermal head having high printing efficiency which reduces power consumption of a thermal printer is necessary.

The above-mentioned conventional thermal head includes an upper substrate, a support substrate which is bonded to the upper substrate on one surface side thereof in a laminated state and which is made of a glass material, a heat generating resistor provided on the upper substrate on the other surface side thereof, and an intermediate layer which is provided between the upper substrate and the support substrate and which has a cavity portion formed in a region opposing to the heat generating resistor. The conventional thermal head is designed to efficiently use heat generated in the heat generating resistor by high heat insulating performance of the cavity portion and the heat accumulation effect of the support substrate and to improve the heating efficiency.

However, the intermediate layer of this conventional thermal head is formed of a plate-shaped glass material having a melting point lower than those of the upper substrate and the support substrate. Therefore, a part of the cavity portion may be filled because of the reduced viscosity of the intermediate layer in melting, or the shape of the cavity portion may not be maintained and be crushed because of the load of the upper substrate. Therefore, there is a problem that a desired hollow shape is not obtained stably and a uniform and sufficient heat insulating effect is not exerted.

SUMMARY OF THE INVENTION

Therefore, in this technical field, there are desired a thermal head and a printer which exert a uniform and sufficient heat insulating effect and suppress heat dissipation to the support substrate while maintaining the print quality, and a method of manufacturing the thermal head easily.

According to one exemplary embodiment of the present invention, there is provided a thermal head, comprising: a support substrate; an upper substrate arranged on the support substrate on one surface side thereof in a laminated state; an intermediate layer which is arranged between the upper substrate and the support substrate to bond the upper substrate and the support substrate to each other, and which has one of a through hole and a concave portion to form a cavity portion between the upper substrate and the support substrate; and a heat generating resistor formed on a surface of the upper substrate on a side opposite to the support substrate at a position opposed to the cavity portion, in which the upper substrate has a melting point lower than a melting point of the intermediate layer.

According to one exemplary embodiment of the present invention, the support substrate, the intermediate layer, the upper substrate, and the heat generating resistor are laminated in a thickness direction to constitute a laminated structure, and the cavity portion is formed of one of the through hole and the concave portion of the intermediate layer between the support substrate and the upper substrate in a region opposed to the heat generating resistor. The upper substrate having the heat generating resistor formed on the surface thereof functions as a heat storage layer which stores heat generated in the heat generating resistor. The cavity portion formed between the support substrate and the upper substrate in the region opposed to the heat generating resistor functions as a heat-insulating layer which blocks the heat generated in the heat generating resistor. Therefore, it is possible to suppress transfer and dissipation of the heat generated in the heat generating resistor to the support substrate through the upper substrate and to improve the heat utilization.

In this case, the upper substrate has a melting point lower than that of the intermediate layer, and hence, when the upper substrate is formed on the intermediate layer by heat treatment, the viscosity of the intermediate layer is prevented from being reduced, and the through hole or the concave portion is prevented from being crushed or deformed. Therefore, the support substrate and the upper substrate are bonded to each other in a laminated state through the intermediation of the intermediate layer, and the cavity portion having a desired shape is formed in the intermediate layer while maintaining the shape of the through hole or the concave portion. As a result, the uniform and sufficient heat insulating effect is exerted, and the heat dissipation to the support substrate is suppressed while maintaining the print quality.

In the one exemplary embodiment of the present invention, the upper substrate may be formed in a range which is larger than an opening area of the one of the through hole and the concave portion of the intermediate layer and which is smaller than an area of the one surface of the support substrate.

In this configuration, the upper substrate has a partially protuberant shape on the one surface of the support substrate. Therefore, the heat generating resistor protrudes more from the one surface of the support substrate in a lamination direction. In this way, in a case where the thermal head is mounted on a thermal printer, a platen roller touches the heat generating resistor in an improved manner. Further, a material for the upper substrate is reduced, and therefore the cost is also reduced.

According to one exemplary embodiment of the present invention, there is provided a printer, including: any one of the above-mentioned thermal heads; and a pressure mechanism which delivers a thermal recording medium while pressing the thermal recording medium against the heat generating resistor of the thermal head.

According to one exemplary embodiment of the present invention, due to the thermal head which suppresses heat dissipation to the support substrate while maintaining the print quality, printing is performed on thermal paper with less electric power and high efficiency. Therefore, battery duration is increased.

According to one exemplary embodiment of the present invention, there is provided a method of manufacturing a thermal head, including: forming an intermediate layer having one of a through hole and a concave portion by arranging an intermediate layer material on one surface of a support substrate and performing heat treatment thereto, the intermediate layer material having a melting point lower than a melting point of the support substrate; forming an upper substrate so as to close an opening portion of the one of the through hole and the concave portion by arranging an upper substrate material on a surface of the intermediate layer formed in the forming an intermediate layer and performing heat treatment thereto, the upper substrate material having a melting point lower than a melting point of the intermediate layer; and forming a heat generating resistor in a region opposed to the one of the through hole and the concave portion on a surface of the upper substrate formed in the forming an upper substrate.

According to one exemplary embodiment of the present invention, the forming an upper substrate includes forming a laminated substrate having a cavity portion between the upper substrate and the support substrate by arranging the upper substrate and the support substrate through intermediation of the intermediate layer in a laminated state and closing the opening portion of the one of the through hole and the concave portion. The cavity portion functions as a hollow heat-insulating layer which blocks heat to be transferred from the upper substrate side to the support substrate side. The heat generating resistor is formed on the surface of the upper substrate in the resistor forming step in such a manner that the heat generating resistor becomes opposed to the one of the through hole and the concave portion of the intermediate layer. Therefore, the thermal head in which the cavity portion suppresses dissipation of the heat generated in the heat generating resistor to the support substrate side through the upper substrate and in which an amount of heat to be used is increased is formed.

In this case, the upper substrate material has a melting point lower than that of the intermediate layer material, and hence, when the upper substrate is formed on the intermediate layer by heat treatment in the upper substrate forming step, the viscosity of the intermediate layer is prevented from being reduced, and the through hole or the concave portion is prevented from being crushed or deformed. Therefore, in the upper substrate forming step, the upper substrate is formed on the support substrate in a laminated state, and the cavity portion having a desired shape is formed while maintaining the shape of the through hole or the concave portion of the intermediate layer. As a result, the thermal head which exerts the uniform and sufficient heat insulating effect and which suppresses the heat dissipation to the support substrate while maintaining the print quality is easily manufactured.

In the one exemplary embodiment of the present invention, the forming an upper substrate may include arranging the upper substrate material on the surface of the intermediate layer and performing heat treatment thereafter in such a manner that the support substrate on the upper substrate material side faces downward in a vertical direction.

In this configuration, when performing heat treatment to the upper substrate material in the upper substrate forming step, the viscosity of the upper substrate material is prevented from being so low that the surface tension becomes low enough to cause the upper substrate material to drip into the through hole or the concave portion of the intermediate layer. Therefore, the cavity portion is formed between the support substrate and the upper substrate with high accuracy, and the thermal head having the cavity portion of a desired shape is manufactured more easily and stably.

The thermal head and the printer according to the one exemplary embodiment of the present invention exert the uniform and sufficient heat insulating effect and suppress the heat dissipation to the support substrate while maintaining the print quality. Further, in the method of manufacturing a thermal head according to the one exemplary embodiment of the present invention, the above-mentioned thermal head is easily manufactured.

DETAILED DESCRIPTION OF THE PREFERRED EMBODIMENTS

A thermal head, a printer, and a method of manufacturing a thermal head according to an embodiment of the present invention are described in the following with reference to the attached drawings.

Figure 1:
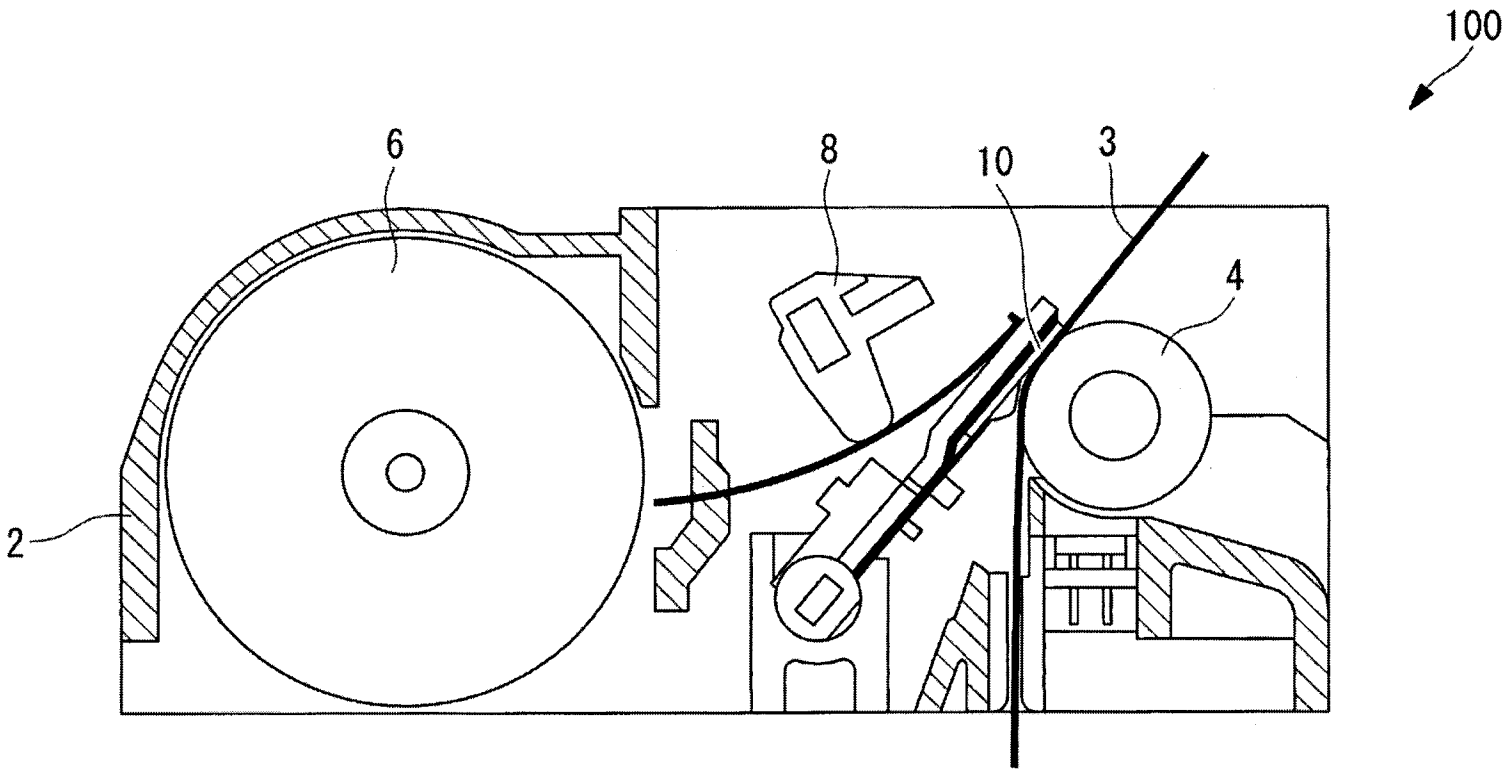
FIG. 1 is a schematic configuration diagram of a thermal printer according to an embodiment of the present invention.

As illustrated in FIG. 1, a thermal printer (printer) 100 according to the embodiment of the present invention includes a body frame 2, a platen roller 4 provided horizontally, a thermal head 10 provided so as to be opposed to an outer peripheral surface of the platen roller 4, a paper feed mechanism 6 for feeding thermal paper (thermal recording medium) 3 to a nip between the platen roller 4 and the thermal head 10, and a pressure mechanism 8 for pressing, with predetermined pressing force, the thermal head 10 against the thermal paper 3.

The thermal paper 3 and the thermal head 10 are pressed against the platen roller 4 by the actuation of the pressure mechanism 8. This causes the load by the platen roller 4 to be imposed via the thermal paper 3 on the thermal head 10. By pressing a heat generating portion of the thermal head 10 against the thermal paper 3, the thermal paper 3 exhibits a color to carry out printing.

Figure 2:
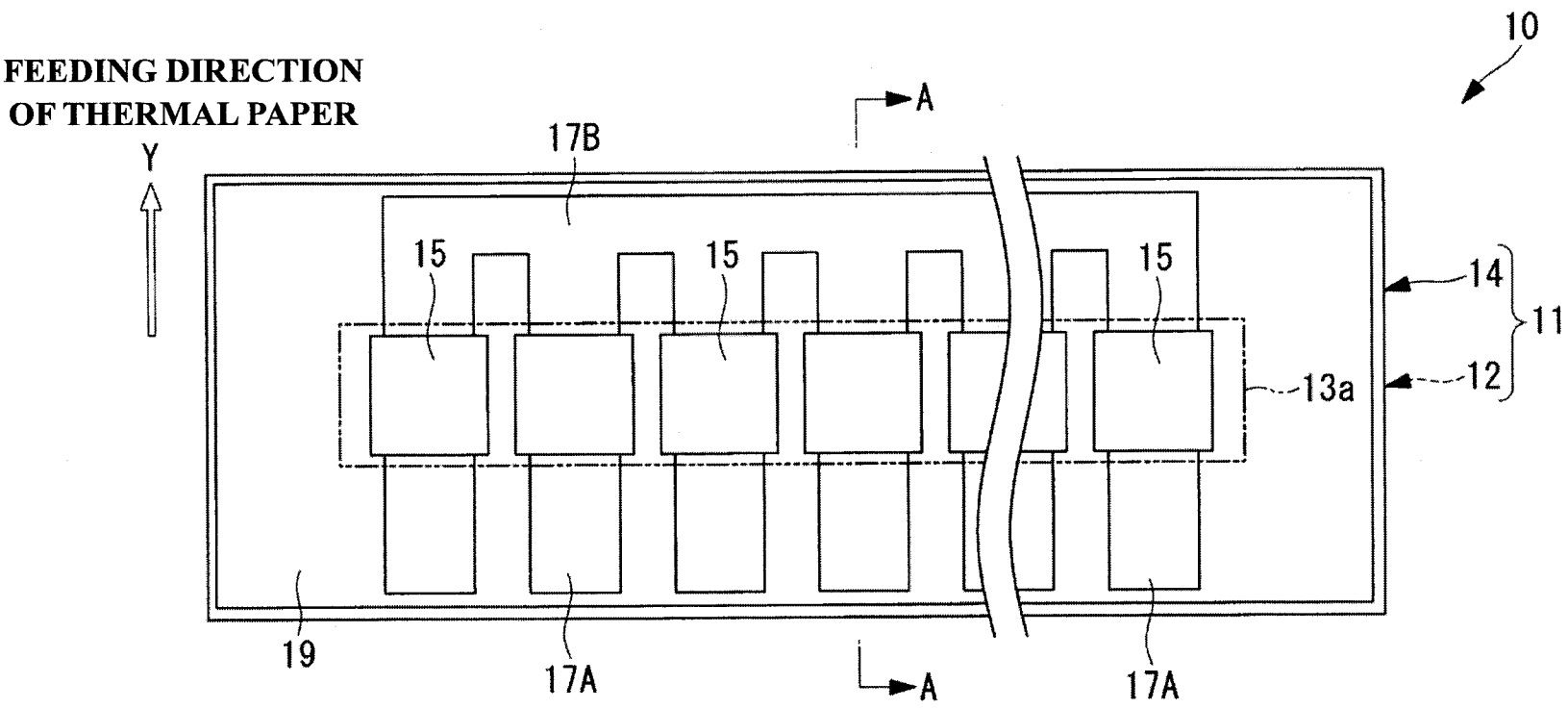
FIG. 2 is a plan view of a thermal head of FIG. 1 seen from a protective film side toward a lamination direction.

As illustrated in FIG. 2, the thermal head 10 is formed so as to be substantially plate-like. The thermal head 10 includes a laminated substrate 11 formed of a glass material, a plurality of heat generating resistors 15 formed on the laminated substrate 11, electrode portions 17A and 17B formed on the laminated substrate 11 so as to be in contact with the respective heat generating resistors 15, and a protective film 19 which covers the heat generating resistors 15 and the electrode portions 17A and 17B to protect those members against wear and corrosion. The thermal paper 3 is fed by the platen roller 4 in the direction of an arrow Y.

Figure 3:
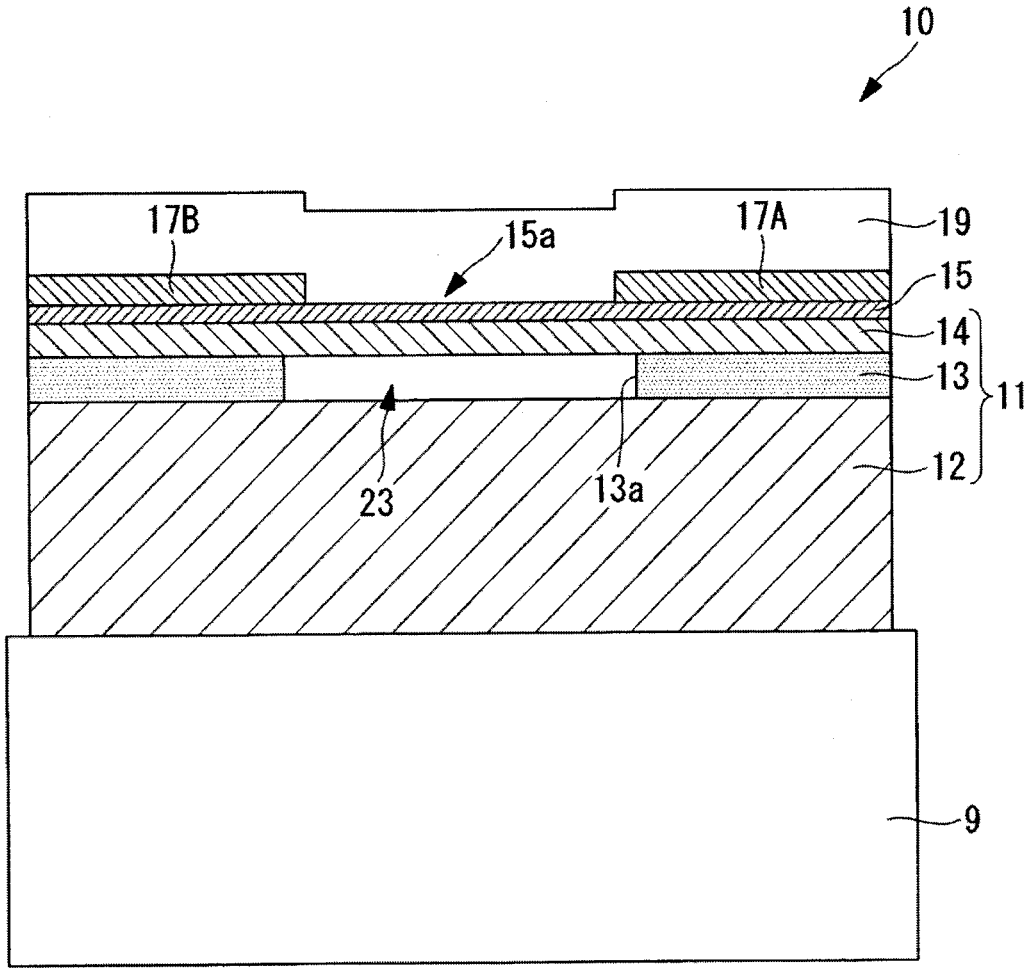
FIG. 3 is a vertical sectional view of the thermal head of FIG. 2 taken along the line A-A.

As illustrated in FIG. 3, the laminated substrate 11 is fixed to a heat sink 9 which is a plate-shaped member formed of a metal such as aluminum, a resin, ceramic, glass, or the like so as to dissipate heat via the heat sink 9. The laminated substrate 11 is formed by providing in a laminated state a plate-shaped support substrate 12 fixed to the heat sink 9, a plate-shaped upper substrate 14 having the heat generating resistor 15 formed on the surface thereof, and an intermediate layer 13 which is arranged between the support substrate 12 and the upper substrate 14 to bond the support substrate 12 and the upper substrate 14 to each other.

The support substrate 12 is made of an alumina material, a silicon material, a metal material (copper, tantalum), or the like, and has a thickness of about zero point several to 1 mm, for example. In the embodiment of the present invention, as the support substrate 12, for example, a ceramic substrate made of an alumina material is used. The support substrate 12 has a melting temperature (firing temperature) of about 1,300 to 1,450° C., for example.

The intermediate layer 13 is made of a glass paste, a green sheet, or thin plate glass, and has a thickness of about 50 to 100 μm, for example. In the embodiment of the present invention, as the intermediate layer 13, for example, a glass layer made of a glass paste is used. The intermediate layer 13 has a melting temperature of about 1,000 to 1,200° C., for example.

The intermediate layer 13 has a through hole 13*a* passing therethrough in a thickness direction. The through hole 13*a* is formed at a position opposed to the heat generating resistor 15 in a plate thickness direction. The through hole 13*a* has a substantially rectangular opening portion which extends along a longitudinal direction of the support substrate 12, and is formed into such a size that all the heat generating resistors 15 are opposed thereto in the plate thickness direction.

The upper substrate 14 is made of a glass paste, a green sheet, or thin plate glass, and has a thickness of about 10 to 100 μm, for example. In the embodiment of the present invention, as the upper substrate 14, a glass substrate made of a glass paste is used. The upper substrate 14 has a melting temperature of 600 to 900° C., for example.

The upper substrate 14 is formed almost over the entire region of one surface of the support substrate 12. The upper substrate 14 has the heat generating resistor 15 formed on one surface thereof which is opposite to the support substrate 12 side, and functions as a heat storage layer which stores part of heat generated in the heat generating resistor 15.

The heat generating resistor 15 is formed of, for example, a Ta-based or silicide-based material, and is formed in the shape of a substantially rectangle. Further, the heat generating resistor 15 has a length in the longitudinal direction which is larger than the width of the through hole 13*a* of the intermediate layer 13. The heat generating resistors 15 are provided so that the longitudinal direction thereof is the width direction of the upper substrate 14, and are arranged at predetermined intervals along the longitudinal direction of the upper substrate 14 (longitudinal direction of the through hole 13*a* of the intermediate layer 13).

The electrode portions 17A and 17B include a plurality of individual electrodes 17A each of which is connected to one end of a heat generating resistor 15 in the longitudinal direction, and a common electrode 17B which is common to all the heat generating resistors 15 and is connected to the other end of each of the heat generating resistors 15 in the longitudinal direction. As the electrode portions 17A and 17B, for example, a wiring material such as Al, Al—Si, Au, Ag, Cu, or Pt is used.

These electrode portions 17A and 17B can supply electric power from an external power supply (not shown) to the heat generating resistors 15 to cause the heat generating resistors 15 to generate heat. A region in the heat generating resistor 15 between the individual electrode 17A and the common electrode 17B, that is, a region in the heat generating resistor 15 substantially immediately above the through hole 13*a* of the intermediate layer 13 is a heat generating portion 15*a*.

The protective film 19 is formed on one surface of the upper substrate 14 which includes the heat generating resistor 15 and the electrode portions 17A and 17B. As the protective film 19, a protective film material such as $SiO_2$, $Ta_2O_5$, SiAlON, $Si_3N_4$, or diamond-like carbon is used.

In the thermal head 10 formed in this way, by closing the opening of the through hole 13*a* of the intermediate layer 13 by the support substrate 12 and the upper substrate 14, a cavity portion 23 is formed between the support substrate 12 and the upper substrate 14. The cavity portion 23 has a communicating structure which is opposed to all the heat generating resistors 15. The cavity portion 23 functions as a hollow heat-insulating layer for suppressing transfer of heat generated by the heat generating portion 15*a* of the heat generating resistor 15 from the upper substrate 14 side to the support substrate 12 side.

Figure 4:
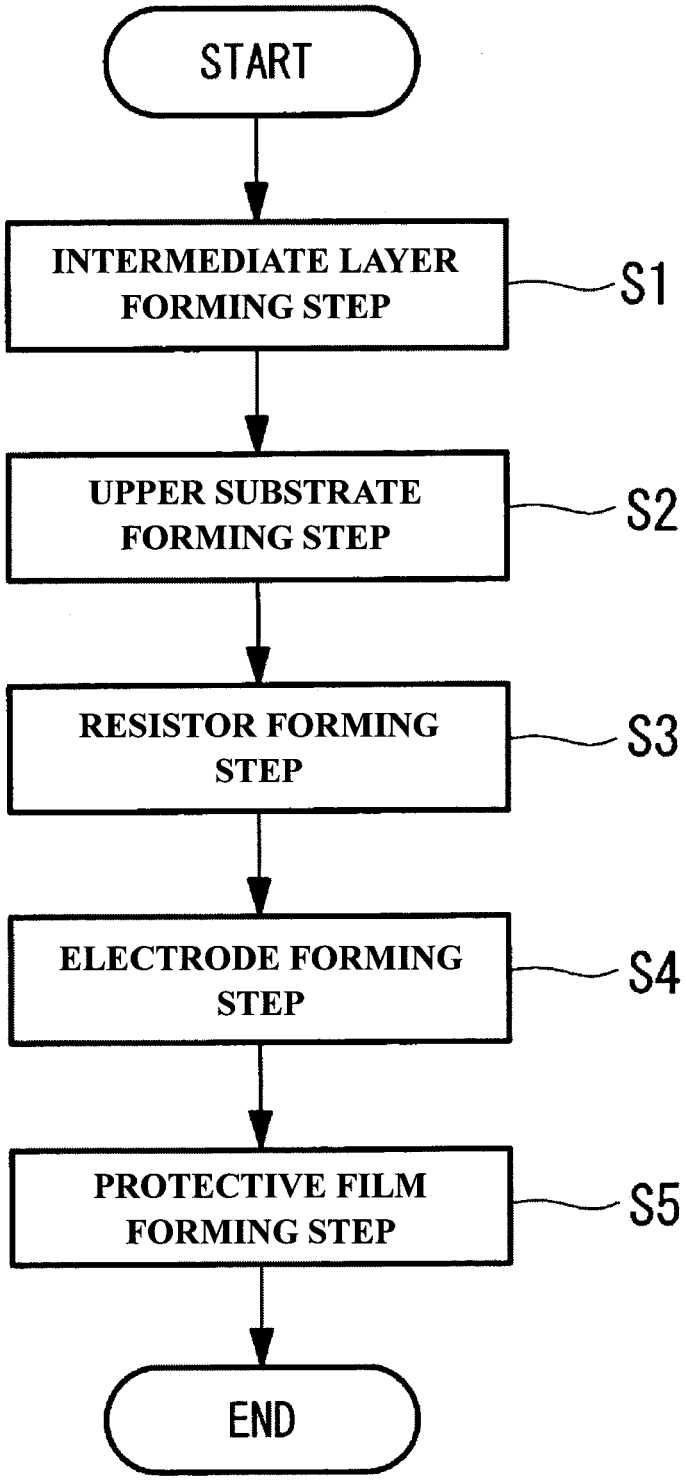
FIG. 4 is a flowchart illustrating a method of manufacturing the thermal head of FIG. 2.

Next, a method of manufacturing the thermal head 10 formed in this way is described with reference to a flowchart of FIG. 4.

The method of manufacturing the thermal head 10 according to the embodiment of the present invention includes an intermediate layer forming step S1 of forming the intermediate layer 13 by arranging an intermediate layer material on one surface of the support substrate 12, an upper substrate forming step S2 of forming the upper substrate 14 by arranging an upper substrate material on a surface of the intermediate layer 13 formed in the intermediate layer forming step S1, and a resistor forming step S3 of forming the heat generating resistor 15 on a surface of the upper substrate 14 formed in the upper substrate forming step S2.

Figure 5A:
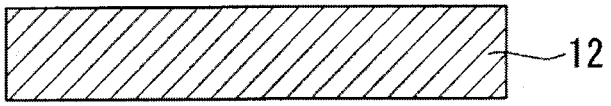
FIG. 5A is a vertical sectional view illustrating a support substrate processing step of a method of manufacturing a thermal head according to the embodiment of the present invention.
Figure 5B:
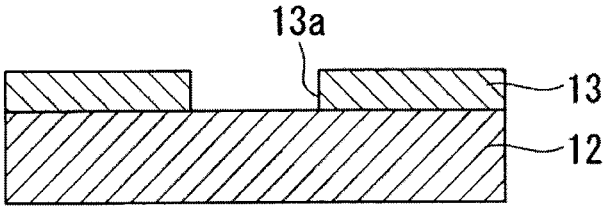
FIGS. 5B and 5C are vertical sectional views illustrating an intermediate layer forming step of the method of manufacturing a thermal head according to the embodiment of the present invention.
Figure 5C:
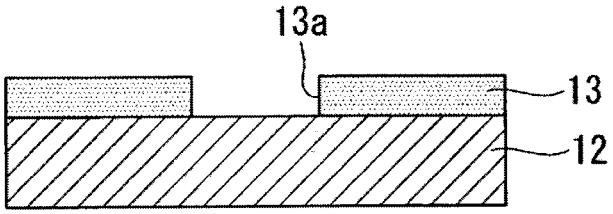

In the intermediate layer forming step S1, in a region other than a region in which the through hole 13*a* is formed on the one surface of the support substrate 12, the intermediate layer material having a melting point lower than that of the support substrate 12 is arranged and is subjected to heat treatment. Specifically, in the intermediate layer forming step S1, on the one surface of the support substrate 12 illustrated in FIG. 5A, a glass paste is subjected to screen printing as illustrated in FIG. 5B, and then, the glass paste is melted to form the intermediate layer 13 as illustrated in FIG. 5C. As the glass paste, for example, there is used a glass fit having a melting point lower than a firing temperature of the support substrate 12 and higher than a melting temperature of the upper substrate 14.

Figure 5D:
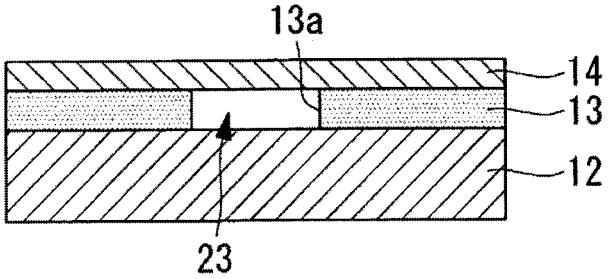
FIGS. 5D and 5E are vertical sectional views illustrating an upper substrate forming step of the method of manufacturing a thermal head according to the embodiment of the present invention.
Figure 5E:
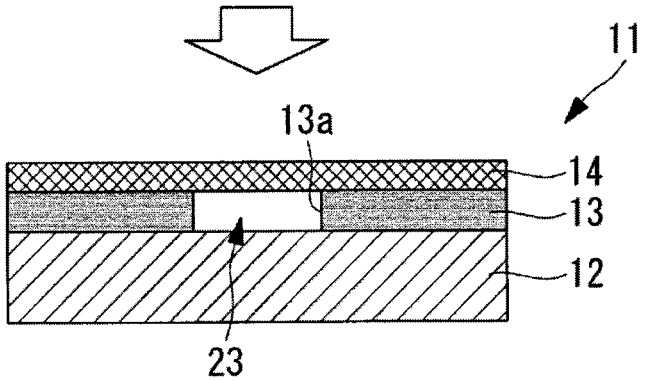

In the upper substrate forming step S2, on the surface of the intermediate layer 13, the upper substrate material having a melting point lower than that of the intermediate layer 13 is arranged and is subjected to heat treatment, and the upper substrate 14 is formed in such a manner that the opening portion of the through hole 13*a* of the intermediate layer 13 is closed. Specifically, in the upper substrate forming step S2, as illustrated in FIG. 5D, a glass paste having a melting temperature lower than those of the support substrate 12 and the intermediate layer 13 is subjected to screen printing, and then, as illustrated in FIG. 5E, the glass paste is melted to form the upper substrate 14.

In the upper substrate forming step S2, the upper substrate 14 becomes soft when melted, but the viscosity and the surface tension thereof are high enough with respect to the width of the through hole 13*a* of the intermediate layer 13. Therefore, the glass paste does not drip into the through hole 13*a* to be buried in the intermediate layer 13, and the upper substrate 14 is formed in such a manner that the glass paste is bridged on the surface of the intermediate layer 13 to close the opening portion of the through hole 13*a*.

In this step, after the glass paste is subjected to printing on the surface of the intermediate layer 13, the support substrate 12 may be placed using a fixture in such a manner that the support substrate 12 on the glass paste side faces downward in a vertical direction, and baking may be performed. In this way, the glass paste is reliably prevented from flowing into the through hole 13*a*, and the upper substrate 14 is formed more stably.

Figure 6:
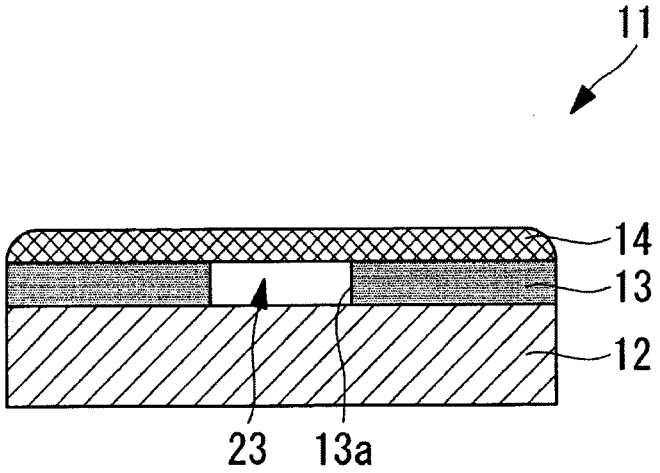
FIG. 6 is a vertical sectional view of a laminated substrate constituting a thermal head according to the embodiment of the present invention.

In the upper substrate forming step S2, the upper substrate 14 is formed on the one surface of the support substrate 12 through the intermediation of the intermediate layer 13 in such a manner that the opening portion of the through hole 13*a* is closed. Therefore, as illustrated in FIG. 6, the laminated substrate 11 having the cavity portion 23 between the support substrate 12 and the upper substrate 14 is formed. At this point, the thickness of the intermediate layer 13 becomes the same as that of the cavity portion 23, and hence the thickness of the hollow heat-insulating layer is easily controlled.

In the resistor forming step S3, the heat generating resistor 15 is formed on the surface of the upper substrate 14 in a region opposed to the through hole 13*a* of the intermediate layer 13. Specifically, in the resistor forming step S3, by using a thin film forming method such as sputtering, chemical vapor deposition (CVD), and vapor deposition, a thin film of a heat generating resistor material is formed on the upper substrate 14. Then, the thin film of the heat generating resistor material is shaped by lift-off, etching, and the like, to thereby form the heat generating resistor 15 having a desired shape.

Next, after the heat generating resistor 15 is formed on one surface of the laminated substrate 11, the electrode portions 17A and 17B are formed on the one surface of the laminated substrate 11 in an electrode forming step S4, and the protective film 19 is formed in a protective film forming step S5. The electrode portions 17A and 17B and the protective film 19 are produced by the conventional method of manufacturing those components in a thermal head.

For example, in the electrode forming step S4, similarly to the resistor forming step S3, a film of the wiring material is formed on the upper substrate 14 by sputtering, vapor deposition, and the like and is shaped by lift-off or etching, or the wiring material is baked after screen printing, thereby forming the individual electrode 17A and the common electrode 17B which have desired shapes.

In the protective film forming step S5, after the heat generating resistor 15 and the electrode portions 17A and 17B are formed, a film of the protective film material is formed on the upper substrate 14 by sputtering, ion plating, CVD, and the like, to thereby form the protective film 19.

From the above-mentioned steps, the thermal head 10 is completed which has the heat generating resistor 15, the electrode portions 17A and 17B, and the protective film 19 formed on the one surface of the laminated substrate 11 having the support substrate 12 and the upper substrate 14 bonded to each other in a laminated state through the intermediation of the intermediate layer 13, and which has the cavity portion 23 formed between the support substrate 12 and the upper substrate 14 in a region opposed to the heat generating resistor 15.

In this case, the upper substrate 14 has a melting point lower than that of the intermediate layer 13, and hence, when the upper substrate 14 is formed on the intermediate layer 13 by heat treatment in the upper substrate forming step S2, the viscosity of the intermediate layer 13 is prevented from being reduced, and the through hole 13*a* is prevented from being crushed or deformed. Therefore, the support substrate 12 and the upper substrate 14 are bonded to each other in a laminated state through the intermediation of the intermediate layer 13, and the cavity portion 23 having a desired shape is formed in the intermediate layer 13 while maintaining the shape of the through hole 13*a*.

Description is given next of the function of the thermal head 10 manufactured in this way and the thermal printer 100.

In order to print on the thermal paper 3 by using the thermal printer 100 according to the embodiment of the present invention, first, a voltage is selectively applied to the individual electrode 17A of the thermal head 10 on one side. This causes a current to flow through the heat generating resistor 15 to which the selected individual electrode 17A and the opposed common electrode 17B are connected, and the heat generating portion 15*a* generates heat.

Subsequently, the pressure mechanism 8 is operated, and the thermal head 10 is pressed against the thermal paper 3 fed by the platen roller 4. The platen roller 4 rotates about an axis parallel to an arrangement direction of the heat generating resistors 15, and delivers the thermal paper 3 in the Y direction perpendicular to the arrangement direction of the heat generating resistors 15. The heat generating portion 15*a* of the heat generating resistor 15 is pressed against the thermal paper 3 so that color is developed and printing is performed on the thermal paper 3.

In this case, in the thermal head 10, the cavity portion 23 of the laminated substrate 11 functions as the hollow heat-insulating layer, and hence, out of heat generated in the heat generating portion 15*a*, there is a reduced amount of heat to be transmitted to the support substrate 12 side through the upper substrate 14 serving as the heat storage layer, and the heat capacity is reduced. Therefore, heat generated in the heat generating resistor 15 is used efficiently, and the heating efficiency is improved.

As described above, according to the thermal head 10 and the thermal printer 100 of the embodiment of the present invention, the support substrate 12 and the upper substrate 14 are bonded to each other in a laminated state through the intermediation of the intermediate layer 13, and the cavity portion 23 having a desired shape is formed in the intermediate layer 13 while maintaining the shape of the through hole 13*a*. As a result, a uniform and sufficient heat insulating effect is exerted, and heat dissipation to the support substrate 12 is suppressed while maintaining the print quality. Further, according to the method of manufacturing a thermal head of the embodiment of the present invention, the above-mentioned thermal head is easily manufactured.

In the embodiment of the present invention, as an example, the method involving printing and melting a glass paste to form the upper substrate 14 is described. However, when using a thin plate glass as the upper substrate 14, the upper substrate may be arranged on the surface of the intermediate layer 13 in a laminated state, and may be bonded to the intermediate layer 13.

In this case, a thin plate glass having a thickness of 100 μm or less is difficult to be manufactured and handled, and is also expensive. Therefore, instead of directly bonding the thin plate glass having such a small thickness to the intermediate layer 13, a thin plate glass thick enough to be easily manufactured and handled may be first bonded to the surface of the intermediate layer 13, and the thin plate glass may be processed to have a desired thickness thereafter by etching, polishing, and the like (thinning step). In this way, the extremely thin upper substrate 14 is formed easily at low cost on the surface of the intermediate layer 13.

The embodiment of the present invention is modified as follows.

In the embodiment of the present invention, the intermediate layer 13 has the through hole 13*a*. However, in a first modified example, the intermediate layer 13 may have a concave portion to form a cavity portion between the upper substrate 14 and the support substrate 12.

Even in this case, the upper substrate 14 is formed on the surface of the intermediate layer 13 in such a manner that the opening portion of the concave portion is closed, and hence the cavity portion is formed between the support substrate 12 and the upper substrate 14 in a region opposed to the heat generating resistor 15. In this case, a depth of the concave portion of the intermediate layer 13 is the same as the thickness of the cavity portion 23, and hence the thickness of the hollow heat-insulating layer is easily controlled.

Figure 7:
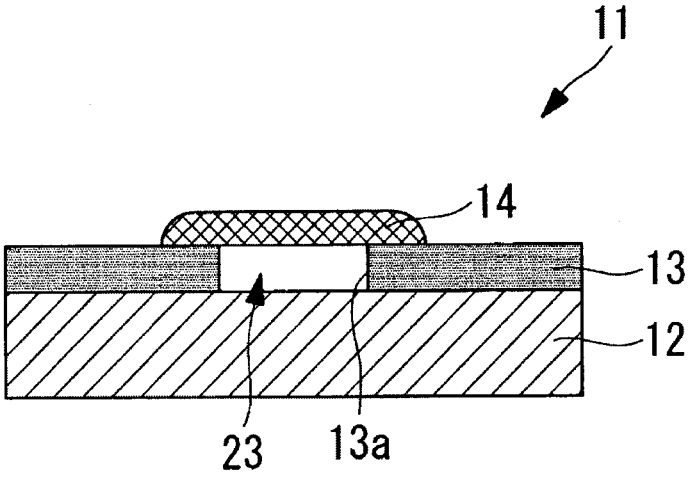
FIG. 7 is a vertical sectional view of a laminated substrate constituting a thermal head according to a first modified example of the embodiment of the present invention.

Further, in the embodiment of the present invention, as illustrated in FIG. 6, the upper substrate 14 is formed almost over the entire region of the one surface of the support substrate 12. However, in a second modified example, for example, as illustrated in FIG. 7, the upper substrate 14 may be formed in a range which is larger than an opening area of the through hole 13*a* or the concave portion of the intermediate layer 13 and which is smaller than an area of the one surface of the support substrate 12.

In this way, the upper substrate 14 has a partially protuberant shape on the one surface of the support substrate 12. Therefore, the heat generating resistor 15 protrudes more from the one surface of the support substrate 12 in a lamination direction. In this way, in a case where the thermal head 10 is mounted on the thermal printer 100, the platen roller 4 touches the heat generating resistor 15 in an improved manner. Further, a material for the upper substrate 14 is reduced, and therefore the cost is also reduced.

What is claimed is:

1. A thermal head comprising:

a support substrate;

an upper substrate arranged on the support substrate on one surface side thereof in a laminated state;

an intermediate layer which is arranged between the upper substrate and the support substrate to bond the upper substrate and the support substrate to each other, and which has one of a through hole and a concave portion to form a cavity portion between the upper substrate and the support substrate; and a heat generating resistor formed on a surface of the upper substrate on a side opposite to the support substrate at a position opposed to the cavity portion, wherein the intermediate layer is formed of a glass paste having a melting point lower than a firing temperature of the support substrate and higher than a melting temperature of the upper substrate.

2. A thermal head according to claim 1, wherein the upper substrate is formed in a range which is larger than an opening area of the one of the through hole and the concave portion of the intermediate layer and which is smaller than an area of the one surface side of the support substrate.

3. A printing device comprising:

a thermal head according to claim 2;

a paper feed mechanism for feeding a thermal recording medium; and a pressure mechanism for pressing the thermal head against the thermal recording medium.

4. A printing device comprising:

a thermal head according to claim 1;

a paper feed mechanism for feeding a thermal recording medium; and a pressure mechanism for pressing the thermal head against the thermal recording medium.

5. A thermal head according to claim 1, wherein the melting point of the intermediate layer is lower than a melting point of the support substrate.

6. A thermal head according to claim 1, wherein the upper substrate is arranged substantially over the entire one surface side of the support substrate.

7. A thermal head according to claim 1, wherein the upper substrate is arranged only over a portion of the one surface side of the support substrate so as to close the cavity portion of the intermediate layer.

8. A thermal head comprising:

a laminated substrate comprised of a support substrate and an upper substrate bonded to the support substrate through intermediation of an intermediate layer having a cavity portion formed between the support substrate and the upper substrate, the intermediate layer being formed of a glass paste having a melting point lower than a firing temperature of the support substrate and higher than a melting temperature of the upper substrate; and a plurality of heat generating resistors formed on the upper substrate opposite to the cavity portion of the intermediate layer in a thickness direction of the laminated substrate so that the cavity portion suppresses transfer of heat generated by the heat generating resistors from the upper substrate to the support substrate.

9. A thermal head according to claim 8, wherein the upper substrate is arranged substantially over an entire surface of the support substrate.

10. A thermal head according to claim 8, wherein the upper substrate is arranged only over a portion of a surface of the support substrate so as to completely cover the cavity portion of the intermediate layer.

11. A thermal head according to claim 8, wherein the melting point of the intermediate layer is lower than a melting point of the support substrate.

12. A printing device comprising:

a thermal head according to claim 8;

a paper feed mechanism for feeding a thermal recording medium; and a pressure mechanism for pressing the thermal head against the thermal recording medium.

* * * * *